United States Patent [19]

Jörgensen

[11] 4,098,197

[45] Jul. 4, 1978

[54] COMPOSITE SHELVING SYSTEM

[75] Inventor: Ib Offer Jörgensen, Holbaek, Denmark

[73] Assignee: Nord-Plan Stalreoler A/S, Vipperod, Denmark

[21] Appl. No.: 815,166

[22] Filed: Jul. 13, 1977

[51] Int. Cl.[2] ..... A47G 57/16

[52] U.S. Cl. ..... 108/109; 108/111

[58] Field of Search ..... 108/106, 111; 211/191, 211/192

[56] References Cited

U.S. PATENT DOCUMENTS

| | | | |
|---|---|---|---|
| 1,820,716 | 8/1931 | Vance | 108/109 |
| 1,855,242 | 4/1932 | Jarvis | 108/109 |
| 2,896,794 | 7/1959 | Jarvis | 108/109 |
| 2,907,471 | 10/1959 | Henry | 108/109 |
| 3,341,027 | 9/1967 | Mackin | 108/111 |
| 3,693,556 | 9/1972 | Rous | 108/111 |

*Primary Examiner*—Francis K. Zugel

*Attorney, Agent, or Firm*—J. Harold Nissen

[57] ABSTRACT

A composite shelving system having two sidepieces and reactangular shelves arranged therebetween. Each sidepiece is built of two columns joined by connecting means, the shelves comprising protruding supporting means secured in apertures in the columns. The two sidepieces are braced by cross bars. Each column is constituted by a profiled bar having a long main slot for receiving the connecting means, and two small auxiliary slots for fixing the cross bars. The profiled bar has a substantially C-shaped cross section with flanges forming the main slot, the auxiliary slots being provided at the back of the "C". The connecting means are abutting sheet members with bent edge portions inserted into the main slot of the profiled bars.

5 Claims, 7 Drawing Figures

Figure 1:
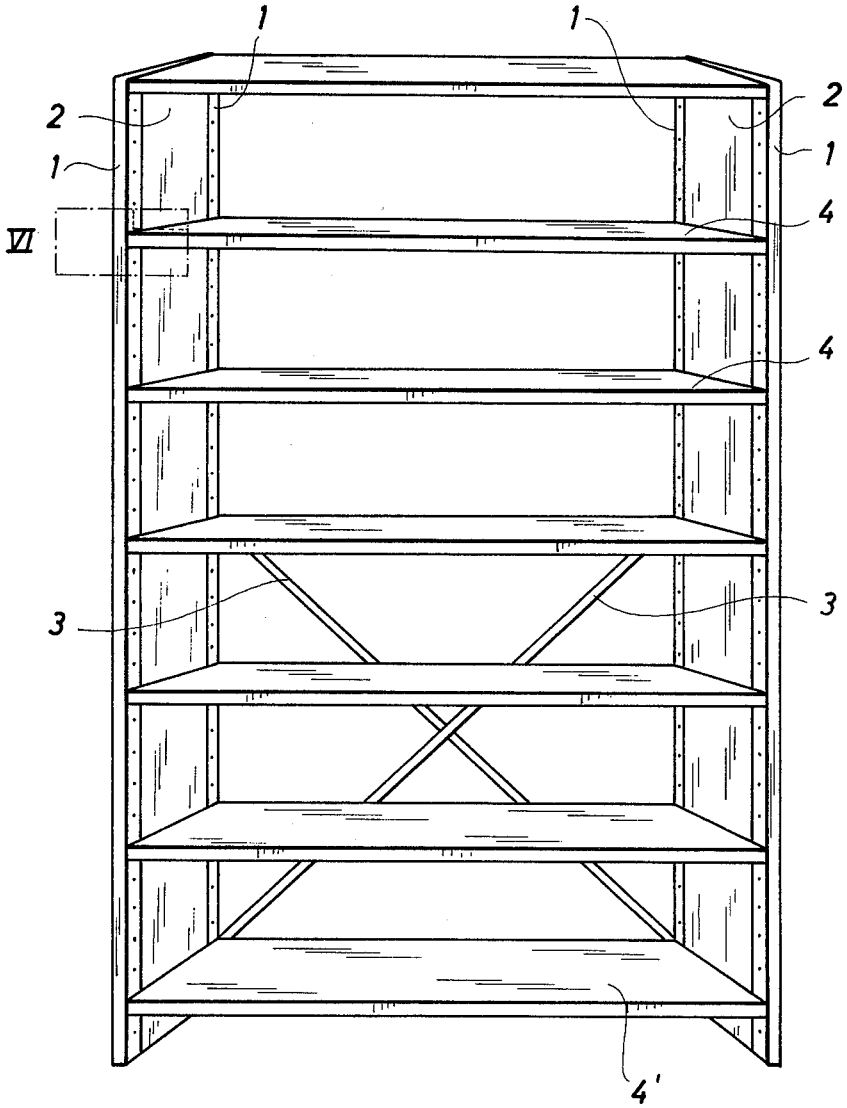

Fig.2
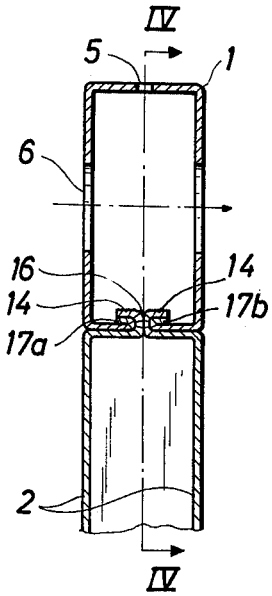
Fig.3
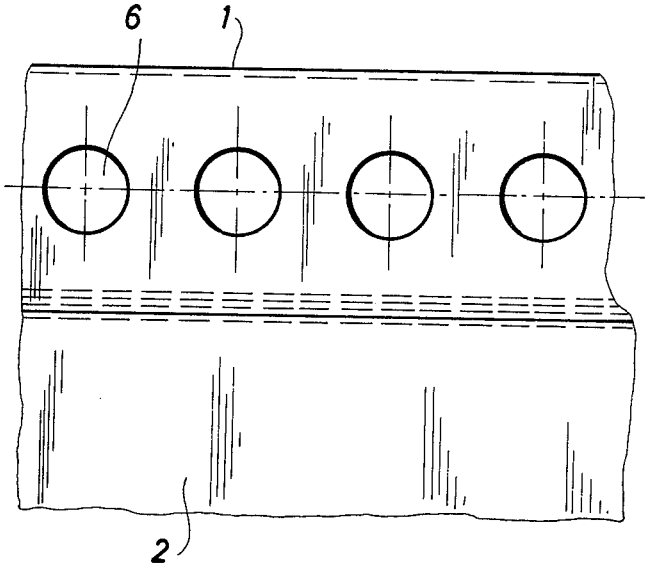
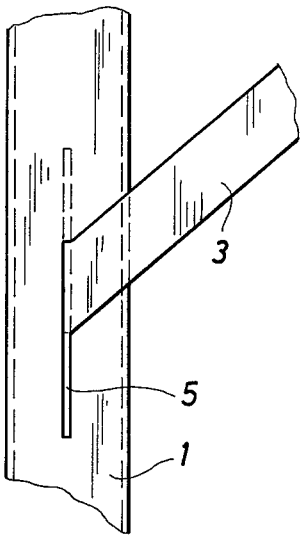
Fig.5
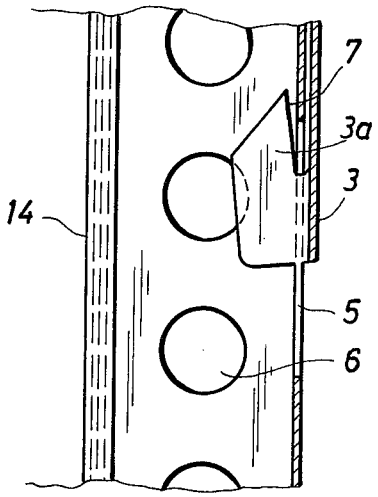
Fig.4

COMPOSITE SHELVING SYSTEM

The present invention relates to a composite shelving system comprising two sidepieces and a plurality of rectangular shelves arranged therebetween, whereby each sidepiece is built of two columns joined by connecting means, and whereby the shelves comprise protruding supporting means secured in apertures in the columns, said apertures facing the centre of the shelving system, and whereby the two sidepieces are braced by cross bars.

U.S. patent specification No. 3,341,027 discloses a shelving system of the above type, whereby each sidepiece comprises two columns connected by bars. Cross bars are provided between the sidepieces, said cross bars being welded or bolted to said sidepieces. The shelves of the shelving system are provided with separate, displaceable, protruding supporting means penetrating apertures in the columns. When assembled this shelving system, however, does not appear sufficiently solid, and it is furthermore rather difficult to assemble and demount owing to the welding or bolting of the cross bars.

French patent specification No. 1,381,522 discloses a shelving system without cross bars, and wherein the sidepieces of the shelving system appear solid. When demounted this shelving system, however, takes up relatively much room.

The object of the invention is to provide a shelving system of the above type which is simple and reliable, and which appears rather solid although it comprises very few units, and which furthermore is very easy to assemble and demount, and which finally does not take up much room when demounted.

The shelving system according to the invention is characterized in that each column is constituted by a profiled bar comprising at least one very long main slot for receiving the connecting means, and at least two small auxiliary slots, into which the ends of the cross bars are loosely insertable since the profiled bar comprises a substantially C-shaped, but almost closed cross section, and since the ends of the free webs of the "C" are bent so as to form flanges, said flanges forming the main slot, whereas the auxiliary slots are provided at the portion of the profiled bar corresponding to the back of the "C", and that the connecting means are constituted by abutting sheet members comprising bent portions at their side edges, said portions being adapted so as to cooperate with the flanges of the profiled bars, whereby the sheet members are inserted into the main slot of the profiled bars, and that the supporting means of the shelves are constituted by tongues cut out of and bent outwards from the shelves, said tongues being capable of clamping the lower portion of the edge of the apertures of the profiled bars. In this manner a shelving system is obtained which is simple and reliable even when detached, and which is very easy to assemble and demount not at least owing to the auxiliary slots of the profiled bars, into which the cross bars only are to be loosely inserted. The main slot of the profiled bars implies a very reliable securing and demounting of the sheet members, whereby the shelving system when assembled appears solid and when demounted does not take up much room since the sheet members may be easily removed from the profiled bars. The particularly shaped supporting means of the shelves increase the reliability of the shelving system since said clamping effect holds the shelves and sidepieces safely in place.

According to the invention the main slots of the profiled bars of each sidepiece may face each other, thus providing a particularly easy securing of the profiled bars to each other.

Furthermore, according to the invention the sheet members may be formed in such manner that their thickness corresponds substantially to the thickness of the profiled bars when mounted, whereby each sidepiece appears as a solid unit.

Moreover, according to the invention the ends of the auxiliary slots and of the cross bars may be formed in such manner that said ends are easily insertable into the slots, whereby the ends of the cross bars comprise hooks made by punching the bar material and a subsequent bending operation, a V-shaped cut being preferably formed during said punching operation. In this manner the end of a cross bar is particularly easy to insert into an auxiliary slot, and since the hold of the hook is sufficient for providing the necessary reliability, it is superfluous to bolt or weld the cross bars.

Finally according to the invention each outwardly bent tongue may at the root have a curved cross section corresponding to the curvature of the edge of the aperture, the tongue resting on said edge.

Figure 6:
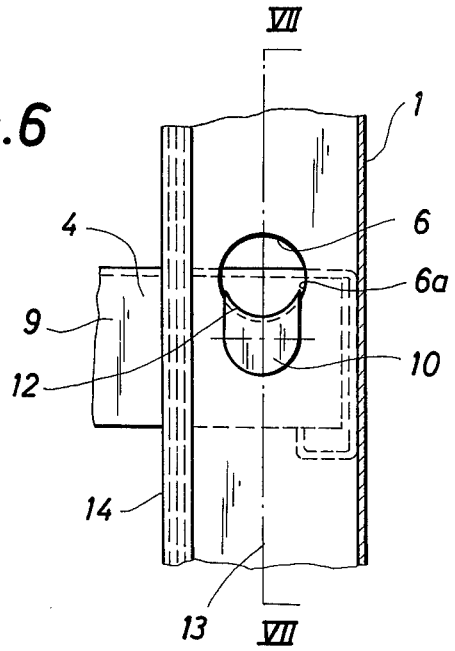
Figure 7:
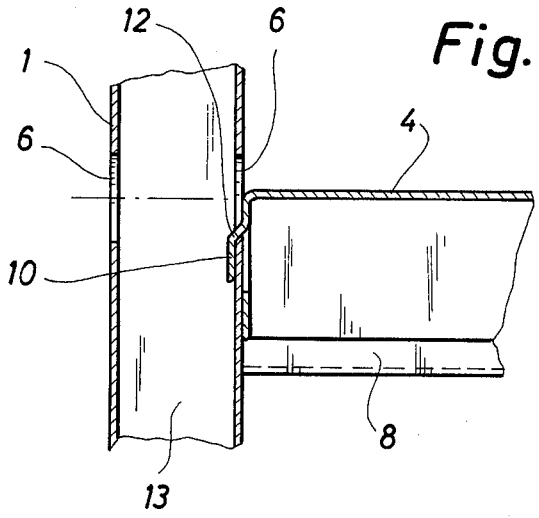

The invention will be described below with reference to the accompanying drawings, in which FIG. 1 is a perspective view of a shelving system according to the invention, FIG. 2 is a cross-sectional view through part of one of the sidepieces of the shelving system, FIG. 3 is a side view of the embodiment of FIG. 2, FIG. 4 is a vertical sectional view taken along the line IV—IV of FIG. 2, illustrating the hook at the end of one of the cross bars of the shelving system, FIG. 5 illustrates the connection between a profiled bar and a cross bar, seen towards the back of the shelving system, FIG. 6 illustrates a connection between a shelf and a profiled bar in the sidepiece, and FIG. 7 is a sectional view of the connection of FIG. 6 taken along the line VII—VII.

The shelving system illustrated in FIG. 1 comprises two sidepieces, each of which being built of two columns 1 and two connecting means 2. The columns are constituted by profiled bars, and the connecting means are constituted by two abutting sheet members. The sheet members comprise bent portions 14 cooperating with flanges 17*a*, 17*b* in the profiled bars, cf. FIG. 2, the latter having a substantially C-shaped cross section. The sidepieces are connected by cross bars 3 loosely secured. Furthermore, the shelving system comprises five rectangular shelves 4 provided with supporting means 10 at their corners, said supporting means engaging the profiled bars 1. As illustrated in FIGS. 1, 2, 3, and 5 each profiled bar 1 comprises a very long main slot 16 for receiving the sheet members 2, and two small auxiliary slots 5, the ends 3*a* of the cross bars 3 being insertable into said auxiliary slots. The cross section of the profiled bar 1 is, as previously mentioned, C-shaped, whereby the free ends of the "C" are rather close to but without contacting each other. The two profiled bars 1 of a sidepiece are preferably positioned in such manner relative to each other that the cavities of the "C's" face each other. They may be made of bent or sheet steel. The free webs of the "C" are apertured at 6, cf. FIGS.

3 and 6. The supporting means of the shelves are formed as tongues 10 and may be secured into said apertures 6.

At both ends the cross bars 3 comprise a hook 3*a* formed by punching a V-shaped cut 7 and subsequently bending the bar at the bottom of the "V". The two hooks 3*a* of each cross bar face each other.

Each shelf 4 is built of a single sheet member formed as an inverted "trough". Thus each shelf comprises bent side walls 8 and 9. As illustrated in detail in FIGS. 6 and 7, two tongues are punched in the end walls, the lower portion of said tongues being semicircular and the upper portion (the root) being curved too, i.e. having a radius substantially corresponding to the radius of the apertures 6 in the profiled bar 1. When punched the tongue 10 is bent somewhat outwards from the shelf at the root 12.

When assembling the shelving system, the two suitably spaced sidepieces are vertically arranged, whereupon the bottom shelf 4', cf. FIG. 1, is brought into engagement with the profiled bars by inserting its tongues 10 into the apertures 6. Subsequently, the shelf is pressed downwards whereby the tongues engage the lower edge 6*a* of the aperture, cf. FIG. 6, and the root 12 rests on said edge.

Subsequently, the cross bars 3 are arranged between the two rear profiled bars 1 of the two sidepieces, whereby the hooks 3*a* are inserted into the auxiliary slots 5. This will present no difficulties since the two sidepieces may still be moved owing to the flexibility of the materials. Then the remaining shelves are assembled suitably spaced above each other in the same manner as described by the shelf 4'.

The root portion 12 illustrated in FIG. 7 implies that the tongue 10 acts satisfactorily both to relatively large and relatively small gauges of metal of the profiled bar 1. The tongues are well protected as a consequence of their position within the cavity 13 of the C-shaped cross section. Each shelf stands a very heavy load before the tongues 10 fail.

As illustrated in FIG. 2, the sheet members 2 are formed in such manner that - when assembled - their thickness corresponds substantially to the thickness of the profiled bars 1, for which reason each sidepiece appears rather solid. When demounted the shelving system and consequently the sidepiece do not take up much room since the sheet members 2 may be stacked.

The shelving system may at both sides be combined with additional sidepieces and shelves, whereby the sidepieces within the shelving system now form intermediate walls. Each auxiliary slot may receive hooks 3*a* from cross bars in two shelving sections. The apertures 6 on both sides of each profiled bar are utilized by shelves situated in their respective section.

The above mentioned columns constituted by profiled bars need not be made of metal. Other materials may be used.

I claim:

1. A composite shelving system comprising two sidepieces and a plurality of rectangular shelves (4) arranged therebetween, whereby each sidepiece is built of two columns (1) joined by connecting means (2), and whereby the shelves (4) comprise protruding supporting means (10) secured in apertures (6) in the columns (1), said apertures facing the centre of the shelving system, and whereby the two sidepieces are braced by cross bars (3), characterized in that each column is constituted by a profiled bar (1) comprising at least one very long main slot (16) for receiving the connecting means (2), and at least two small auxiliary slots (5), into which the ends (3*a*) of the cross bars are loosely insertable since the profiled bar (1) comprises a substantially C-shaped, but almost closed cross section (FIG. 2), and since the ends of the free webs of the "C" are bent so as to form flanges (17*a*,, 17*b*), said flanges forming the main slot (16), whereas the auxiliary slots (5) are provided at the portion of the profiled bar (1) corresponding to the back of the "C", and that the connecting means (2) are constituted by abutting sheet members comprising bent portions (14) at their side edges, said portions being adapted so as to cooperate with the flanges (17*a*, 17*b*) of the profiled bars, whereby the sheet members (2) are inserted into the main slot (16) of the profiled bars, and that the supporting means of the shelves are constituted by tongues (10) cut out of and bent outwards from the shelves, said tongues being capable of clamping the lower portion (6*a*) of the edge of the apertures (6) of the profiled bars.

2. A composite shelving system as claimed in claim 1, characterized in that the main slots (16) of the profiled bars of each sidepiece face each other.

3. A composite shelving system as claimed in claim 1, characterized in that the sheet members (2) are formed in such manner that their thickness corresponds substantially to the thickness of the profiled bars (1) when mounted, whereby each sidepiece appears as a solid unit (FIG. 2).

4. A composite shelving system as claimed in claim 1, characterized in that the ends of the auxiliary slots (5) and of the cross bars are formed in such manner that said ends are easily insertable into the slots (5), whereby the ends of the cross bars comprise hooks (3*a*) made by punching the bar material (3) and a subsequent bending operation, a V-shaped cut (7) being preferably formed during said bending operation.

5. A composite shelving system as claimed in claim 1, characterized in that each outwardly bent tongue at the root has a curved cross section corresponding to the curvature of the edge of the aperture, the tongue resting on said edge.

* * * * *